US006355604B2

(12) United States Patent
Guillemet

(10) Patent No.: US 6,355,604 B2
(45) Date of Patent: Mar. 12, 2002

(54) MULTIFUNCTIONAL AQUEOUS LUBRICANT BASED ON DITHIODIGLYCOLIC ACID

(75) Inventor: François Guillemet, Paris (FR)

(73) Assignee: Atofina, Puteaux (FR)

( * ) Notice: Subject to any disclaimer, the term of this patent is extended or adjusted under 35 U.S.C. 154(b) by 0 days.

(21) Appl. No.: 09/858,552

(22) Filed: May 17, 2001

(30) Foreign Application Priority Data

May 19, 2000 (FR) ..... 00 06457

(51) Int. Cl.[7] ..... C10M 135/24
(52) U.S. Cl. ..... 508/431; 508/439; 508/509
(58) Field of Search ..... 508/431, 439, 508/509

(56) References Cited

U.S. PATENT DOCUMENTS

| | | | | | |
|---|---|---|---|---|---|
| 2,426,496 | A | * | 8/1947 | Farley | 508/509 |
| 3,079,340 | A | | 2/1963 | Reamer | |
| 4,786,424 | A | | 11/1988 | Lindstrom et al. | |
| 4,880,552 | A | * | 11/1989 | Guesnet et al. | 508/509 |
| 4,902,438 | A | * | 2/1990 | O'Connor | 508/509 |
| 5,468,399 | A | * | 11/1995 | Delfort et al. | 508/439 |
| 5,969,019 | A | * | 10/1999 | Kanai et al. | 524/140 |

FOREIGN PATENT DOCUMENTS

| | | |
|---|---|---|
| EP | 0 183 050 | 6/1986 |
| EP | 0 288 375 | 10/1988 |
| JP | 63-265997 | 11/1988 |
| WO | WO 98/08919 | 3/1998 |

OTHER PUBLICATIONS

R.W. Mould, et al., "Investigations of the Activity of Cutting Oil Additives, Part V—The EP Activity of Some Water–Based Fluids," Journal of the American Society of Lubrication Engineers, vol. 33, 6, pp. 291–298.

* cited by examiner

*Primary Examiner*—Jacqueline V. Howard
(74) *Attorney, Agent, or Firm*—Smith, Gambrell & Russell, LLP

(57) ABSTRACT

The multifunctional aqueous lubricant according to the invention comprises at least one water-soluble salt of dithiodiglycolic acid and at least one water-soluble compound chosen from the group consisting of:

a) phosphoric esters of general formula:

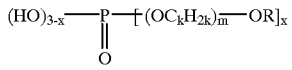

(I)

in which R represents an alkyl, alkenyl or alkylaryl radical having from 6 to 20 carbon atoms, k is equal to 2 or 3, m is a number ranging from 0 to 20 and x is equal to 1 or 2, and their salts, and b) water-soluble salts of alkylthio acids of general formula:

$$R'—S—(CH_2)_n—COOH \quad (II)$$

in which n is a number ranging from 1 to 10 and R' represents an alkyl, alkenyl or aryl radical having from 6 to 20 carbon atoms, the ratio by mass of dithiodiglycolic acid to compound (s) I and/or II being between 1/1 and 50/1.

12 Claims, No Drawings

MULTIFUNCTIONAL AQUEOUS LUBRICANT BASED ON DITHIODIGLYCOLIC ACID

FIELD OF THE INVENTION

The invention relates to the field of lubricants and has more particularly as subject-matter that of aqueous lubricants of use in the working or shaping of metals.

BACKGROUND OF THE INVENTION

Operations in which metals are worked or shaped require the use of a lubricant in order to reduce the stresses between the component to be worked and the tool, to remove the turnings and the debris, to cool and to control the surface condition of the component or of the metal sheet which is being worked. Oil-based lubricants have conventionally been used. They are whole oils or emulsions to which have optionally been added lubricity agents, antiwear (AW) additives and/or extreme pressure (EP) additives. The lubricity agents form a monomolecular covering on the surface to be lubricated and thus reduce wear and friction. When the frictional conditions become more severe, the rise in the temperature results in a desorption of these lubricity agents, and AW or EP additives (generally compounds comprising phosphorus, chlorine or sulphur) are then necessary to lubricate the contact. Under high loads, AW additives make it possible to greatly reduce the wear of the components in contact; EP additives can generate a degree of wear but they prevent the phenomena of welding and of adhesion. Whole oils have excellent lubricating properties but, when throughputs are high, the removal of heat requires the use of emulsions. However, the use of emulsions is also tending to be reduced as, over time, they decompose and produce unpleasant smells.

For this reason, there is increasing use of aqueous fluids, which are either synthetic fluids (aqueous solutions based on water-soluble additives) or semisynthetic fluids (oil-in-water microemulsions comprising a large amount of emulsifiers). However, while aqueous fluids are very efficient in removing heat and have an improved resistance to bacterial proliferation, their use is often restricted to metal working operations where the frictional and wear conditions are not excessively severe. This is because, as AW and EP additives have been developed for oils, very few of them are soluble in water and suitable for aqueous fluids.

There is an overabundance of oil-soluble AW or EP additives but the number of water-soluble AW or EP additives is markedly more restricted. Nevertheless, it is possible to distinguish two main categories of water-soluble additives: phosphorus compounds and sulphur compounds.

The most widely used among phosphorus compounds are phosphoric acid esters obtained by reaction of an ethoxylated or nonethoxylated fatty alcohol with $P_2O_5$. They are soluble in water by neutralization in the form of an alkali metal, ammonium or alkanolamine salt or alternatively by virtue of their ethoxylated part. These esters, which are widely employed in aqueous fluids for the working or shaping of metals because of their AW, emulsifying and corrosion inhibiting properties, are not, however, suitable for operations where the frictional and wear conditions are very severe.

Mention may be made, among sulphur compounds, of alkylthio acids, which are monosulphides composed of an alkyl chain, generally comprising between 6 and 18 carbon atoms, and of a carboxylic acid group. These compounds, which are soluble in water by neutralization in the form of alkali metal, ammonium or alkanolamine salts, are used in aqueous lubricants for the working or shaping of metals for their AW and corrosion inhibiting properties. However, their EP capability is insufficient for very severe operations.

R. W. Mould et al., in Lubr. Eng., 1977, 33(6), 291–298, have reported the EP properties of a few water-soluble sulphur additives, such as sodium salts of thiosalicylic, 2-mercaptopropionic, 2,2'-dithiodibenzoic, 2,2'-dithiodipropionic and dithiodiglycolic acids. The use of salts of 3,3'-dithiodipropionic acid or of dithiodiglycol as EP additives for aqueous lubricants has formed the subject-matter of Patents EP 288 375, JP 63-265997 and EP 183 050, it being possible for 3,3'-dithiodipropionic acid to be used in combination with alkylthio acids for aqueous chasing lubricants (JP 10-110181). Very recently, synergies with regard to the EP capability between acids of this type and orthophosphoric acid have been observed (WO 9808919).

DESCRIPTION OF THE INVENTION

It has now been found that the combination of a water-soluble salt of dithiodiglycolic acid with a water-soluble phosphoric ester or a water-soluble salt of an alkylthio acid makes it possible to obtain multi-functional (lubricity, AW and EP) aqueous lubricants.

A subject-matter of the present invention is thus a multifunctional aqueous lubricant, characterized in that it comprises at least one water-soluble salt of dithiodiglycolic acid and at least one water-soluble compound chosen from the group consisting of:

a) phosphoric acid esters of general formula:

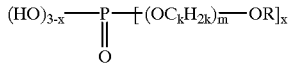

(I)

in which R represents an alkyl, alkenyl or alkylaryl radical, the number of carbon atoms of which can range from 6 to 20, x is equal to 1 or 2, k is equal to 2 or 3 and m is a number ranging from 0 to 20, and their salts, and b) water-soluble salts of alkylthio acids of general formula:

$$R'—S—(CH_2)_n—COOH \quad (II)$$

in which n can range from 1 to 10 and R' denotes an alkyl, alkenyl or aryl radical comprising from 6 to 20 carbon atoms.

Another subject-matter of the invention is an additive for a multifunctional aqueous lubricant composed of an aqueous solution of at least one water-soluble salt of dithiodiglycolic acid and of at least one water-soluble compound chosen from the group consisting of phosphoric acid esters (I) and their salts and of water-soluble salts of alkylthio acids (II).

Mention may more particularly be made, as water-soluble salts of dithiodiglycolic acid $S_2(CH_2COOH)_2$, of salts of alkali metals, of ammonium or of an alkanolamine, such as, for example, monoethanolamine, diethanolamine and triethanolamine.

Preference is given, among the phosphoric esters (I), to those in which k is equal to 2, m is a number ranging from 0 to 10 (in particular 4 to 5) and R is a radical comprising from 10 to 18 carbon atoms. The phosphoric esters (I) are generally mixtures of mono- and diesters in proportions ranging from 10/90 to 90/10. When they are not soluble in water by themselves, these esters can be used in the form of salts of alkali metals, of ammonium or of an alkanolamine.

Preference is given, among the alkylthio acids (II), to those in which n is equal to 1 or 2 and the R' radical comprises from 8 to 18 carbon atoms. Use is preferably made, as water-soluble salts of these acids, of salts of alkali metals, of ammonium or of an alkanolamine, such as monoethanolamine, diethanolamine and triethanolamine.

In the multifunctional aqueous lubricant according to the invention and in the additive which can be used for its preparation, the ratio by mass of dithiodiglycolic acid to compound(s) I and/or II can range from 1/1 to 50/1 but is preferably between 2/1 and 20/1.

In the multifunctional aqueous lubricant according to the invention, the total concentration by mass of dithiodiglycolic acid and of compound(s) I and/or II can range from 0.01 to 20% and is preferably between 0.1 and 10%.

The additive according to the invention can be stored in the form of a concentrate which can be diluted subsequently in synthetic fluids (true solutions) or semisynthetic fluids (microemulsions). This concentrate can comprise additives conventionally employed in synthetic or semisynthetic fluids, such as corrosion inhibitors, emulsifiers, lubricating additives, alkaline agents, antifoaming agents, and the like. The total content by mass of dithiodiglycolic acid and of compound(s) I and/or II in these concentrates can range from 1 to 70% and is preferably between 15 and 40%.

EXAMPLES

In the following examples, which illustrate the invention without limiting it, the percentages shown are expressed by weight.

The chemical natures of the compounds used in these examples are specified in the following Table I.

TABLE I

| Designation | Chemical nature |
|---|---|
| DTDGA | Dithiodiglycolic acid |
| LTPA | Laurylthiopropionic acid |
| LA | Lauric acid* |
| Beycostat A684 | Phosphoric ester of oleyl alcohol comprising 4.5 EO* |
| Beycostat A244 | Phosphoric ester of lauryl alcohol comprising 4 EO |
| Beycostat AB04 | Phosphoric ester of nonylphenol comprising 4 EO |

*EO = ethylene oxide

The phosphoric esters, sold by CECA S.A., are mixtures of mono- and diesters, predominantly of monoester.

The formulations tested, which are all clear, were prepared by diluting the compounds in water and, in the case of the acids, stoichiometrically neutralizing with monoethanolamine (MEA), with sodium hydroxide or with potassium hydroxide. The phosphoric esters were diluted in water as is.

The performances of the various formulations were evaluated according to the following experimental procedures:

1. 4-ball Extreme Pressure Test (ASTM

Evaluation of the antiwear capability by the highest possible value of the load before seizing up (typically≧63 kg) and of the extreme-pressure capability by the highest possible value of the welding load (typically≧250 kg).

Conditions: 1500 rev/min, increasing loads for 10 seconds.

2. Ball-disc Test:

Evaluation of the lubricity or boundary capability of a lubricant by the value of the coefficient of friction $\mu$, which must be as low as possible, typically≦0.10.

The ball-disc test consists in rotating a disc at a constant speed under a ball to which is applied a constant load. The disc and the ball are immersed in the lubricant. A force sensor measures the coefficient of friction of the ball-disc lubricated contact.

Conditions: 1 rev/min, 1 kg, 30 min, 100C6 steel ball on an aluminium 3104 disc.

3. Falex Wear Test (ASTM D2670-88):

A steel shaft, immersed in the lubricant, rotates at a constant speed between two vee-shaped jaws, a constant load being applied to these jaws. At the end of the test, the loss in weight of the two vees and of the shaft is measured and must be less than 20 mg for the formulation to have antiwear properties.

Conditions: 290 rev/min, 480 kg, 15 min, steel 3135 shaft and steel C1137 vees.

In the following Table 2, in which the compositions of the various formulations tested and their performances are summarized, an abbreviation such as LA/MEA means that lauric acid (LA) had been neutralized with monoethanolamine (MEA).

TABLE 2

| | | | Salt of | | Falex wear | | 4-ball EP | |
|---|---|---|---|---|---|---|---|---|
| Ex. No. | Compound I or II | % | Dithio-diglycolic acid | % | Loss in weight (mg) | Ball-disc $\mu$ | Seizing load (kg) | Welding load (kg) |
| 1 | LA/MEA | 2 | None | 0 | 44 | 0.065 | 50 | 126 |
| 2 | LTPA/MEA | 2 | None | 0 | 5 | 0.045 | 80 | 126 |
| 3 | Beycostat A684 | 2 | None | 0 | 5 | 0.033 | 100 | 160 |
| 4 | Beycostat A244 | 2 | None | 0 | — | 0.038 | 100 | 160 |
| 5 | Beycostat AB04 | 2 | None | 0 | — | 0.064 | 100 | 160 |
| 6 | None | 0 | DTDGA/MEA | 5 | — | 0.4 | 20 | 400 |
| 7 | None | 0 | DTDGA/K | 5 | — | 0.4 | 20 | 800 |
| 8 | None | 0 | DTDGA/Na | 5 | 83 | 0.4 | 16 | 800 |
| 9 | Beycostat A684 | 2 | DTDGA/MEA | 5 | — | 0.035 | 100 | 315 |
| 10 | Beycostat A684 | 2 | DTDGA/K | 5 | — | 0.035 | 100 | 500 |
| 11 | Beycostat A684 | 2 | DTDGA/Na | 5 | 3 | 0.036 | 100 | 400 |

TABLE 2-continued

| Ex. No. | Compound I or II | % | Salt of Dithio-diglycolic acid | % | Falex wear Loss in weight (mg) | Ball-disc $\mu$ | 4-ball EP Seizing load (kg) | 4-ball EP Welding load (kg) |
|---|---|---|---|---|---|---|---|---|
| 12 | Beycostat A684 | 0.5 | DTDGA/Na | 5 | 3 | 0.033 | 100 | 500 |
| 13 | Beycostat A244 | 2 | DTDGA/Na | 5 | 5 | 0.043 | 126 | 620 |
| 14 | Beycostat AB04 | 2 | DTDGA/Na | 5 | 3 | 0.086 | 100 | 500 |
| 15 | LTPA/MEA | 2 | DTDGA/MEA | 5 | 16 | 0.050 | 80 | 250 |
| 16 | LA/MEA | 2 | DTDGA/MEA | 5 | 33 | 0.056 | 50 | 400 |

On examining the results in this table, it is found that only the formulations of Examples 9 to 15, in accordance with the invention, exhibit lubricity ($\mu$<0.1), AU (seizing load≧63 kg) and EP (welding load≧250 kg) properties.

The formulations of Examples 1 to 5, which do not comprise a DTDGA salt, all have a welding load of less than 250 kg and the formulations of Examples 6 to 8, which do not comprise compound I or II, all have a load before seizing up of less than 63 kg and a coefficient of friction of greater than 0.1.

The formulation of Example 16, which comprises a mixture of salts of lauric acid and of dithiodiglycolic acid, does not have antiwear properties (final load before seizing up<63 kg and Falex wear>20 mg).

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The foregoing references are hereby incorporated by reference.

What is claimed is:

1. Multifunctional aqueous lubricant comprising at least one water-soluble salt of dithiodiglycolic acid and at least one water-soluble compound selected from the group consisting of:

a) phosphoric esters of formula:

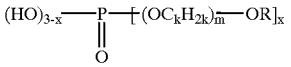

(I)

in which R represents an alkyl, alkenyl or alkylaryl radical having from 6 to 20 carbon atoms, k is equal to 2 or 3, m is a number ranging from 0 to 20 and x is equal to 1 or 2, and their salts, and b) water-soluble salts of alkylthio acids of formula:

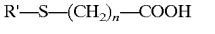

(II)

in which n is a number ranging from 1 to 10 and R' represents an alkyl, alkenyl or aryl radical having from 6 to 20 carbon atoms, the ratio by mass of dithiodiglycolic acid to compound (s) I and/or II being between 1/1 and 50/1.

2. Lubricant according to claim 1, wherein k is equal to 2, m is a number ranging from 0 to 10 and R is a radical having from 10 to 18 carbon atoms.

3. Lubricant according to claim 1, wherein n is equal to 1 or 2 and R' is a radical having from 8 to 18 carbon atoms.

4. Lubricant according to claim 1, wherein the ratio by mass of dithiodiglycolic acid to compound(s) I and/or II is between 2/1 and 20/1.

5. Lubricant according to claim 1, wherein the compound (I) is a mixture of phosphoric mono- and diesters, the number k being equal to 2 and the number m being between 4 and 5.

6. Lubricant according to claim 1, wherein dithiodiglycolic acid and the alkylthio acids (II) are in the form of salts of alkali metals, of ammonium or of an alkanolamine.

7. Additive for a multifunctional aqueous lubricant, comprising a lubricant composed of an aqueous solution of at least one water-soluble salt of dithiodiglycolic acid and of at least one water-soluble compound selected from the group consisting of phosphoric acid esters (I) and their salts and of water-soluble salts of alkylthio acids (II) as defined in claim 1, the ratio by mass of dithiodiglycolic acid to compound(s) I and/or II being between 1/1 and 50/1.

8. Additive according to claim 7, wherein k is equal to 2, m is a number ranging from 0 to 10 and R is a radical having from 10 to 18 carbon atoms.

9. Additive according to claim 7, wherein n is equal to 1 or 2 and R' is a radical having from 8 to 18 carbon atoms.

10. Additive according to claim 7, wherein the ratio by mass of dithiodiglycolic acid to compound(s) I and/or II is between 2/1 and 20/1.

11. Additive according to claim 7, wherein the compound (I) is a mixture of phosphoric mono- and diesters, the number k being equal to 2 and the number m being between 4 and 5.

12. Additive according to claim 7, wherein dithiodiglycolic acid and the alkylthio acids (II) are in the form of salts of alkali metals, of ammonium or of an alkanolamine.

* * * * *